US005696477A

United States Patent [19]

Yamamori et al.

[11] Patent Number: 5,696,477

[45] Date of Patent: Dec. 9, 1997

[54] TRANSFORMER

[75] Inventors: Masaya Yamamori; Nobukazu Nakajima; Toshihisa Kitada, all of Sanda, Japan

[73] Assignee: Tabuchi Electric Co., Ltd., Hyogo, Japan

[21] Appl. No.: 447,508

[22] Filed: May 23, 1995

[30] Foreign Application Priority Data

May 30, 1994 [JP] Japan ..... 6-140854

[51] Int. Cl.[6] ..... H01F 15/10; H01F 27/30

[52] U.S. Cl. ..... 336/192; 336/185; 336/198

[58] Field of Search ..... 336/192, 208, 336/198, 170, 182, 185; 310/71, 194

[56] References Cited

U.S. PATENT DOCUMENTS

| | | | |
|---|---|---|---|
| 2,751,563 | 6/1956 | Willyard et al. | 336/198 |
| 3,407,372 | 10/1968 | Elvers | 336/208 |
| 4,234,865 | 11/1980 | Shigehara | 336/208 |
| 4,639,706 | 1/1987 | Shimiizu | 336/198 |
| 4,857,877 | 8/1989 | Dethienne | 336/198 |

FOREIGN PATENT DOCUMENTS

| | | | |
|---|---|---|---|
| 2442236 | 12/1979 | France | 336/208 |
| 54-13929 | 2/1979 | Japan | 336/208 |
| 61-4208 | 1/1986 | Japan | 336/198 |
| 1161400 | 8/1969 | United Kingdom | 336/208 |

*Primary Examiner*—Thomas J. Kozma

*Attorney, Agent, or Firm*—Hamilton, Brook, Smith & Reynolds, P.C.

[57] ABSTRACT

A transformer includes a bobbin having main and auxiliary bobbin regions (11, 12) separated by an intermediate collar (14) and has primary and secondary windings (16, 17) wound around the main bobbin region (11). A part of the primary or secondary windings (16, 17) or a different winding (18) having a small number of turns other than the primary and secondary windings (16, 17) is wound around the auxiliary bobbin region (12). At least one of the primary and secondary windings (16, 17) is prepared from a winding wire having reinforced insulation of a multi-layered structure. One of the primary and secondary windings (16, 17) which is prepared from the winding wire having reinforced insulation has its lead-out ends opposite to each other which are led through the auxiliary bobbin region (12) to terminal pins (8A) and are then soldered thereto.

6 Claims, 7 Drawing Sheets

PRIOR ART

TRANSFORMER

BACKGROUND OF THE INVENTION

1. Field of the Invention

The present invention generally relates to a transformer for use in, for example, a switching power source device and, more particularly, to the transformer for a high frequency power source designed to be compact in side by winding primary and secondary windings in an overlapping relation with each other around a bobbin.

2. Description of the Prior Art

A transformer for a high frequency power source which is designed to be compact in size is of a structure wherein primary and secondary windings are wound around a bobbin in an overlapping relation. This type of the transformer must satisfy requirements stipulated in the safety standards in connection with electric insulation between the primary and secondary winding and space-creepage (creeping) for insulation. In the transformer which utilizes, for each of the primary and secondary windings, a normal insulated winding wire having a single layer of an insulating film deposited on the surface of the winding wire such as, for example, an enamel-coated winding wire in order for the transformer to satisfy the safety standard requirements, a length of barrier tape made of epoxy is wound around each of opposite ends of a coil bobbin and the primary and secondary windings are wound in a number of turns around a portion of the coil bobbin between the taped ends of the coil bobbin with an electrically insulating tape intervening between each neighboring layers of the turns of the primary and secondary windings. Thus, the space-creepage that satisfies the safety standard requirements is secured between the primary and secondary windings in the presence of the barrier tape at each of the opposite ends of the coil bobbin and, also, electric insulation between the neighboring layers of turns of the primary and secondary windings is established by the insulating tape intervening therebetween.

The transformer of the type discussed above requires a substantial space for winding of the lengths of barrier tape on the opposite ends of the coil bobbin and, therefore, the coil bobbin used therein must be bulky in size to accommodate the length of barrier tape. For this reason, when it comes to the use of the transformer of the above discussed type in the high frequency power source which is generally required to be compact in size, the transformer fails to satisfy the requirement. In addition, assemblage of the transformer of the above discussed type requires an additional process step of winding the lengths of barrier tape on the respective ends of the coil bobbin for each layer of turns of the windings, resulting in an inefficient workability and also in a substantial increase in manufacturing cost.

In view of the foregoing, the transformer in which no barrier tape is employed and, instead, a primary winding is prepared from a winding wire having reinforced insulation such as, for example, a triple insulated winding wire, has been suggested. This suggested transformer is shown in FIG. 10 and will now be discussed in detail with reference to FIG. 10.

The transformer shown in FIG. 10 includes a coil bobbin 5 has an EI-shaped core assembly 6 including a generally E-shaped core 6*a* and a generally I-shaped core 6*b* assembled together to define a magnetic circuit A primary winding 1 includes winding portions 1*a* and 1*b* wound around the coil bobbin 5 and has an intermediate tap wire drawn between the winding portions 1*a* and 1*b* and, so far shown in FIG. 10, forms first and fourth layers in a direction transversely outwardly of the coil bobbin 5. Secondary windings 2*a* and 2*b* and a base winding 3, both prepared from an enamel-coated winding wire, are also wound around the coil bobbin 5. This primary winding 1 is prepared from a triple insulated winding wire which, in an assembled condition, provides a required electric insulation between the primary winding 1 and both of the secondary and base windings 2*a*, 2*b* and 3. Each neighboring layers of turns of each of the windings 1*a*, 1*b*, 2*a*, 2*b* and 3 are insulated from each other in the presence of a length of insulating tape 4.

According to the suggested transformer shown in FIG. 10, it is also suggested to use the triple insulated winding wire for the secondary windings 2*a* and 2*b*, not for the primary winding 1 and that the use of the length of insulating tape 4 is not always essential.

Connection of the winding wire having the insulating layer of the three-layered structure which forms the primary winding 1, with terminal pins 8A associated with the primary winding 1 is generally carried out by passing opposite ends of the primary winding through lead-out grooves 5*c* defined in one of opposite collars, e.g., the collar 5*a*, of the coil bobbin 5 towards the respective terminal pins 8A and then soldering them to the terminal pins 8A as at H. For this reason, the three-layered insulation at a portion S1 of each of the opposite ends of the primary winding 1, where soldering is effected and which is shown as hatched with horizontal lines in FIG. 7, tends to be thermally deteriorated during the soldering process to such an extent as to result in a considerable reduction in electrically insulating property. The three-layered insulation on the triple insulated winding wire when its insulating property is reduced loses a function of securing the necessary space-creepage distance.

In the transformer of the type discussed with reference to FIG. 10, the one collar 5*a* where rows of terminal pins 8A and 8B associated respectively with the primary winding 1 and the secondary windings 2*a* and 2*b* are secured is chosen to have a thickness greater than that of the other collar 5*b* so that the space-creepage distance D which satisfies the safety standard requirements is provided between portions S2 of the lead-out ends of the primary winding 1, where thermal deterioration does not take place, and ends of the secondary winding 2*a*. In other words, while the transformer of the type discussed with reference to FIG. 10 is effective to dispense with a complicated job of winding of the lengths of the barrier tape, the size of the coil bobbin 5 as a whole cannot be reduced as compared with the coil bobbin having the lengths of the barrier tape wound and, therefore, the transformer shown in FIG. 10 is not suited for use in the high frequency power source which requires to be compact in size.

SUMMARY OF THE INVENTION

Accordingly, the present invention has been devised to provide an improved transformer in which the space-creepage distance that satisfies the safety, standard requirements is secured among the windings and which can be assembled in a compact size.

To accomplish this and other objects of the present invention, the present invention provides a transformer which comprises a bobbin having a longitudinal axis and also having a through-hole defined therein so as to extend axially thereof, a core member inserted in the through-hole, an intermediate collar mounted on the bobbin at a location generally intermediate of the length of the bobbin with said bobbin consequently having main and auxiliary bobbin regions defined on respective sides of the intermediate collar in a direction axially of the bobbin, and primary and secondary windings being wound around the bobbin in an overlapping relation. At least one of the primary and secondary windings is prepared from a winding wire having reinforced insulation. Opposite ends of said at least one of the primary and secondary windings are soldered to terminal pins after having traversed the auxiliary bobbin region.

In this transformer according to the present invention, either some of the turns of said at least one of the primary and secondary winding or a third winding being wound around the auxiliary bobbin region while the remaining turns of said at least one of the primary and secondary windings and the other of the primary and secondary windings are wound around the main bobbin region.

In a preferred embodiment of the present invention, the intermediate collar is formed with a plurality of insertion grooves inwardly recessed from an outer edge of the intermediate collar for passage of either the primary winding or the secondary winding so as to extend from the main bobbin region to the auxiliary bobbin region. Alternatively, the intermediate collar may be formed with lead-out grooves each extending from an inner portion to the outer edge of the intermediate collar and inclined downwardly towards the auxiliary bobbin region for passage of either the primary winding or the secondary winding so as to extend from the main bobbin region to the auxiliary bobbin region.

According to another preferred embodiment of the present invention, the bobbin has first to fourth side faces, the first and second side faces being opposite to each other in a direction radially outwardly of the bobbin while the third and fourth side faces are opposite to each other in the direction radially outwardly of the bobbin. The bobbin has an additional collar mounted thereon adjacent the auxiliary bobbin region, and first and second rows of terminal pins associated respectively with the first and second windings are secured to the additional collar so as to extend in a direction parallel to the longitudinal axis of the bobbin. Respective free ends of the terminal pins of the respective rows are used to be plugged into associated holes in a printed circuit board. In view of the terminal pins of the respective rows extending parallel to the longitudinal axis of the bobbin, the transformer when the free ends of the terminal pins are plugged into the holes in the printed circuit board assumes an upright position and, hence, the transformer itself is of an upright type. In this transformer of the upright type, the insertion grooves are defined in one portion of the intermediate collar of the auxiliary bobbin region adjacent at least one of the third and fourth side faces of the bobbin, and the first and second rows of the terminal pins are provided adjacent the first and second side faces, respectively.

In a modified form of the transformer of the upright type, while one of the primary and secondary windings is prepared from the winding wire having reinforced insulation, the other of the primary and secondary windings may be prepared from a normal insulated winding wire having a single insulating layer and, in such case, such one of the primary and secondary windings is passed through the insertion groove, and a portion of the intermediate collar adjacent the terminal pins for the other of the primary and secondary windings is formed with second insertion grooves for passing the other therethrough.

According to a further preferred embodiment of the present invention, the bobbin having the first to fourth side faces, may have first and second collars protruding radially outwardly from respective opposite ends thereof with the intermediate collar positioned generally therebetween. The rows of the terminal pins associated respectively with the primary and secondary windings are secured to the first and second collars adjacent the first side of the bobbin, thereby rendering the transformer as a whole to be of a transverse type which, when the transformer is mounted on the printed circuit board with the free ends of the terminal pins plugged into the holes in the printed circuit board, lies generally parallel to the printed circuit board. In this case, the insertion grooves are defined in one portion of the intermediate collar adjacent at least one of the second, third and fourth side faces of the bobbin.

According to the present invention, the entire turns of, or some of the turns of the primary and secondary windings are formed on the main bobbin region of the bobbin in the overlapping relation. At least one of the primary and secondary windings is in the form of the winding wire having reinforced insulation having a plurality of insulating layers. On the other hand, the auxiliary bobbin region of the bobbin is wound with a small number of turns of a different winding such as, for example, a base winding or the remaining turns of such one of the primary and secondary windings.

In this transformer according to the present invention, since such one of the primary and secondary windings is prepared from the winding wire having reinforced insulation, i.e., an winding wire having a multi-layered insulation such as, for example, a triple insulated winding wire, the space-creepage distance for insulation between the turns of the primary and secondary windings can be advantageously secured in the presence of the insulating layer of the multi-layered structure. The lead-out ends of the winding wire having reinforced insulation are, after having traversed the auxiliary bobbin region, soldered to the terminal pins.

Accordingly, the lead-out ends of such one of the primary and secondary windings which is prepared from the winding wire having reinforced insulation are necessarily longer than the width of the auxiliary bobbin region as measured in the direction axially of the bobbin. For this reason, even though the insulating property of the insulating layer covering portions of the lead-out ends adjacent the site where soldering is lowered under the influence of soldering heat, the space-creepage distance between tip portions of the lead-out end of the winding wire having reinforced insulation, which are not thermally deteriorated, and the lead-out ends of the other of the primary and secondary windings extends a length along an inner surface of the auxiliary bobbin region which satisfactorily satisfies the safety standard requirements. In other words, the transformer according to the present invention is so designed that the auxiliary bobbin region which is primarily used for winding of a winding wire therearound is effectively utilized to secure the required space-creepage distance and, therefore, as compared with the prior art coil bobbin, the bobbin used in the transformer of the present invention can be manufactured compact in size sufficient to allow the transformer to be used in a high frequency power source.

According to a preferred embodiment of the present invention, the primary or secondary windings can be smoothly guided from the main bobbin region to the auxiliary bobbin region through the insertion grooves or lead-out grooves formed in the intermediate collar.

According to another preferred embodiment of the present invention, in the transformer of the upright type in which the rows of the terminal pins are secured to the collar of the auxiliary bobbin region adjacent the first and second side faces of the bobbin, respectively, the insertion grooves are formed in the intermediate collar adjacent the third and fourth side faces of the bobbin, respectively. Therefore, such one of the primary and secondary windings which is prepared from the winding wire having reinforced insulation extend from the main bobbin region to the auxiliary bobbin region through the insertion grooves after having detoured from the third or fourth side face of the bobbin to the first or second side face of the bobbin, with the lead-out ends thereof subsequently welded to the terminal pins. Accordingly, the space-creepage distance from those portions of the lead-out ends of the winding wire having reinforced insulation which are soldered to the terminal pins and which are not thermally deteriorated, to the other of the primary and secondary windings is further lengthened. Also, where such one of the primary and secondary windings which is prepared from the winding wire having reinforced insulation is passed through the insertion groove while the other of the primary and secondary windings which is prepared from the normal insulated winding wire is passed through the second insertion groove, the possibility of the winding wires being mingled which would occur when the winding wires are passed through one and the same insertion groove is advantageously eliminated and, therefore, a line drawing and a soldering can easily be accomplished.

According to a further preferred embodiment of the present invention, since the transformer of the transverse type is so designed that the insertion grooves are formed adjacent the second side face of the bobbin opposite to the first side face of the bobbin where the respective rows of the terminal pins are disposed or the third or fourth side face of the bobbin, such one of the primary and secondary windings which is prepared from the winding wire having reinforced insulation have its lead-out ends soldered to the terminal pins after having passed through the insertion groove so as to detour from a portion of the bobbin adjacent the second, third or fourth side face to another portion of the bobbin adjacent the first side face. Accordingly, even in this transverse type of the transformer, the space-creepage distance from those portions of the lead-out ends of the winding wire having reinforced insulation which are soldered to the terminal pins and which are not thermally deteriorated, to the other of the primary and secondary windings is further lengthened.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS

Hereinafter, some preferred embodiments of the present invention will be described.

Figure 1:
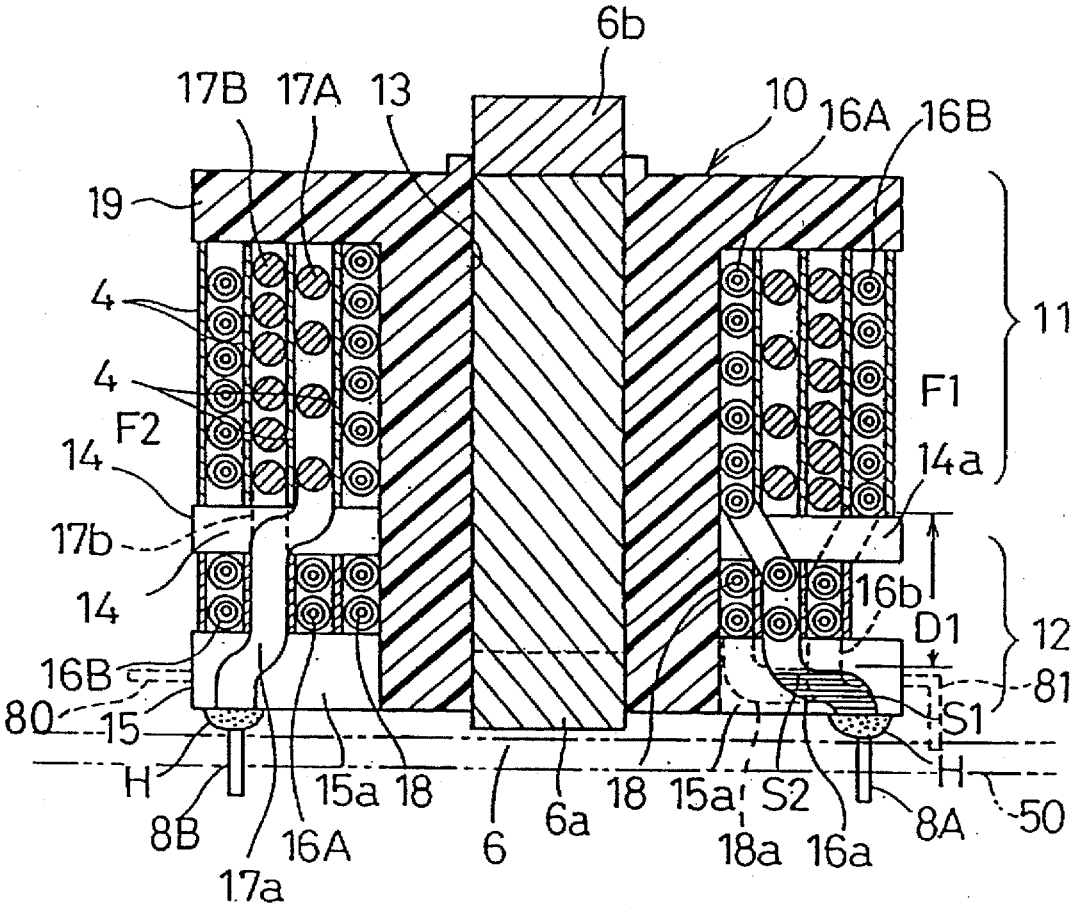
FIG. 1 is a longitudinal sectional side view of a transformer according to a first preferred embodiment of the present invention.
Figure 2:
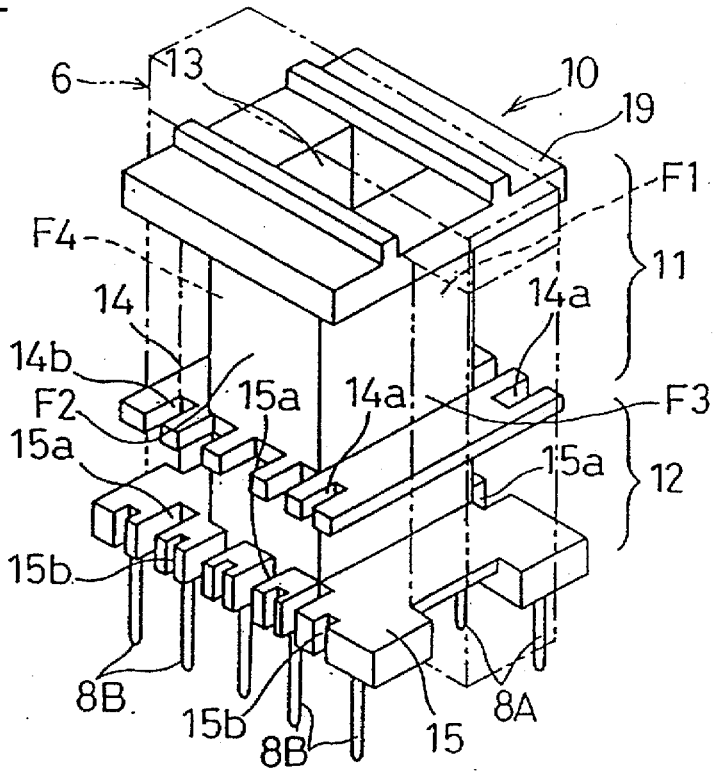
FIG. 2 is perspective view of a bobbin used in the transformer shown in FIG. 1.

FIGS. 1 and 2 illustrate a longitudinal sectional side view of an upright transformer according to a first preferred embodiment of the present invention and a perspective view of a bobbin used therein. Referring particularly to FIGS. 1 and 2, the bobbin generally identified by 10 is of one-piece construction including a main bobbin region 11 of a first axial length, an auxiliary bobbin region 12 of a second axial length smaller than the first axial length, and an axially extending through-hole 13 for insertion of a core 6 therethrough. This bobbin 10 is of a generally rectangular cross-section having first to fourth side faces F1, F2, F3 and F4 and includes first, intermediate and third collars 19, 14 and 15 formed integrally therewith so as to be radially outwardly flanged therefrom. The first and second collars 19 and 15 are situated at opposite ends of the bobbin 10, respectively, while the intermediate collar 14 is situated generally intermediate between the first and second collars 19 and 15. The main bobbin region 11 is delimited between the first and intermediate collars 19 and 14 while the auxiliary bobbin region 12 is delimited between the intermediate and second collars 14 and 15.

The intermediate collar 14 separating the main and auxiliary bobbin regions 11 and 12 from each other includes four collar pieces continued together around the bobbin 10 and protruding radially outwardly and transversely from the respective first to fourth side faces F1 to F4 of the bobbin 10 and, of them, the opposite collar pieces protruding radially outwardly and transversely from the first and second side faces F1 and F2 opposite to each other are formed with respective pluralities of insertion grooves **14*a* and 14*b*, each of said insertion grooves 14*a* and 14*b* being inwardly recessed from an outer edge of the corresponding collar piece and extending completely across the thickness of the intermediate collar 14. Similarly, the second collar 15 of the auxiliary bobbin region 12 formed at a lower end of the bobbin 10 includes four collar pieces continued together around the bobbin 10 and protruding radially outwardly and transversely from the respective first to fourth side faces F1 to F4 of the bobbin 10 and, of them, the opposite collar pieces protruding radially outwardly and transversely from the opposite first and second side faces F1 and F2 are formed with respective pluralities of lead grooves 15*a* and 15*b*, said lead grooves 15*a* and 15*b* in each of the opposite collar pieces of the second collar 15** alternating with each other.

The second collar 15 of the auxiliary bobbin region 12 is provided with first and second rows of a required number of terminal pins 8A and 8B secured thereto by the use of a known insert-molding technique so as to extend outwardly from the auxiliary bobbin region 12 in a direction generally parallel to the longitudinal sense of the bobbin 10 with the first and second rows of the terminal pins 8A and 8B positioned on respective sides adjacent the first and second side faces F1 and F2 of the bobbin 10. It is to be noted that, as will become clear from the subsequent description, the first and second rows of the terminal pins 8A and 8B are associated with primary and secondary windings, respectively. The respective rows of the terminal pins 8A and 8B have their free ends adapted to be plugged into associated terminal holes formed in a printed circuit board 50 to thereby permit the core 6, inserted in the axial through-hole 13, to be mounted upright on the printed circuit board 50 as shown in FIG. 1.

Figure 3:
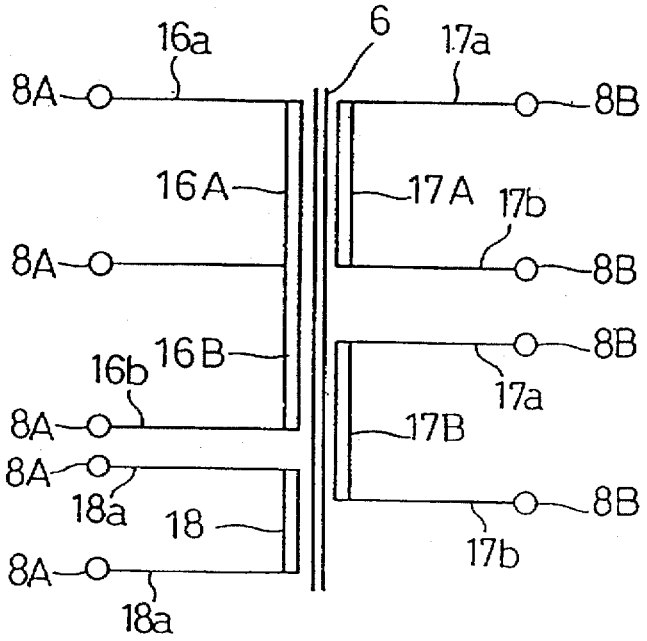
FIG. 3 is a diagram showing an equivalent circuit of the transformer.

So far illustrated in FIG. 1, the transformer shown therein is of an upright type for use in a switching power source device. For this purpose, the bobbin 10 includes a primary winding 16, first and second secondary windings 17, and a base winding (a different winding) 18 all wound around the bobbin 10. Specifically, the primary winding 16 includes first and second winding portions 16A and 16B and a relatively great number of winding turns of the primary winding 16 is wound around the main bobbin region 11 while the remaining number of winding turns of the primary winding 16 is wound around the auxiliary bobbin region 12. The entire number of winding turns of each of first and second secondary windings 17A and 17B is also wound around the main bobbin region 11 in an overlapping relation with the primary winding 16. Namely, the primary and secondary windings 16 and 17 are overlapping with each other. On the other hand, the entire number of winding turns of the base winding 18 is wound around the auxiliary bobbin region 12. The primary winding 16, the first and second secondary windings 17A and 17B and the base winding 18 are magnetically coupled with each other through the core 6 as shown in FIG. 3 which illustrates an equivalent wiring circuit of the illustrated transformer. It is to be noted that the base winding 18 referred to above is used to drive switching elements.

The first and second winding portions 16A and 16B of the primary winding 16, which are shown in FIG. 1 as forming first and fourth winding layers as viewed in a direction radially outwardly from the bobbin 10 and which are wound around the main bobbin region 11, and the base winding 18 which is also shown in FIG. 1 as forming the first winding layer as viewed in the direction radially outwardly from the bobbin 10 and which is wound around the auxiliary bobbin region 12 are prepared from a winding wire having reinforced insulation of a multi-layered structure such as, for example, a triple insulated winding wire which is a winding wire having two insulator layers of modified polyester and an outermost insulator layer of polyamide. The first and second secondary windings 17A and 17B which are similarly shown as forming second and third winding layers around the main bobbin region 11 are prepared from a normal insulated winding wire such as, for example, an enamel-coated winding wire. Any known insulating tape 4 is interposed between each neighboring winding layers of any one of the primary, secondary and base windings. The intervening insulating tapes 4 are made of, for example, polyester, and serve not only to insulate the neighboring winding layers from each other, but also to avoid any possible displacement of winding turns of any one of the primary, secondary and base windings 16, 17 and 18 during an coiling operation and to protect the winding turns of any one of the primary, secondary and base windings 16, 17 and 18 from an external mechanical force which would act thereon from a lateral inward direction.

Figure 4:
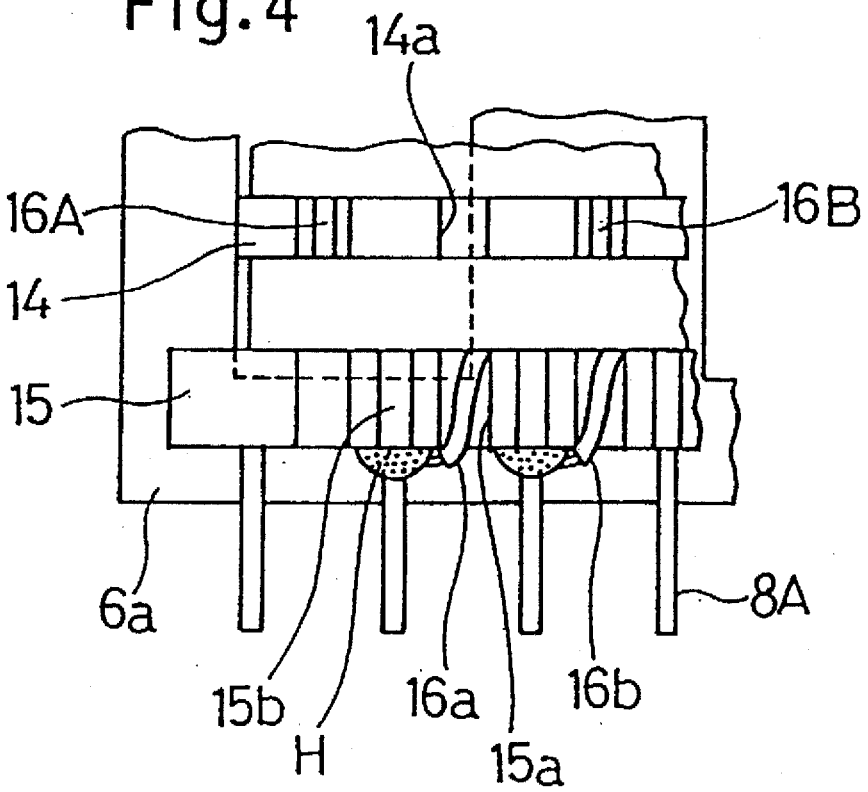
FIG. 4 is a front elevational view, on an enlarged scale, of a portion of the transformer shown in FIG. 1.

The primary winding 16 has lead-out ends **16*a* and 16*b* opposite to each other (a lead-out end 16*b* of an intermediate tap wire drawn from a joint between the winding portions 16A and 16B is abbreviated for the sake of brevity) and also has a generally intermediate portion of said primary winding 16 continuously wound around the main bobbin region 11 of the bobbin 11. End portions of the primary winding 16 pass through the first insertion groove 14*a* and are wound around the auxiliary bobbin region 12. The lead-out ends 16*a* and 16*b* of the primary winding 16 extend downwardly outwardly from the auxiliary bobbin region 12, as viewed in FIG. 1, through corresponding two of the lead grooves 15*a* in the second collar 15 and are, as best shown in FIG. 4, in turn soldered as at H to corresponding two of the terminal pins 8A of the first row adjacent the first side face F1. On the other hand, the first and second secondary windings 17A and 17B wound around the main bobbin region 11 have their lead-out ends 17*a* and 17*b* which extend downwardly through corresponding two of the insertion grooves 14*b* in the intermediate collar 14 and which are, after subsequently traversing the auxiliary bobbin region 12, passed through two of the lead grooves 15*a* and then soldered as at H to corresponding two of the terminal pins 8B of the second row adjacent the second side face F2 in a similar manner as shown in FIG. 4**.

It is to be noted that, since as hereinbefore described the primary winding 16 prepared from the winding wire having reinforced insulation exhibits a high electric insulating property, no relatively large space for insulation is needed between the lead-out ends **17*a* and 17*b* of the secondary windings 17A and 17B and the winding portions 16A and 16B of the primary winding 16. With respect to the base winding 18 wound around the auxiliary bobbin region 12, lead-out ends 18*a* thereof extend outwardly through corresponding two of the lead grooves 15*a* in the second collar 15 and are then soldered as at H to corresponding two of the terminal pins 8A** of the first row adjacent the first side face F1.

In the transformer according to the embodiment of the present invention shown in FIGS. 1 to 4, the three-layered insulation formed on the primary winding 16 made of the winding wire having reinforced insulation is effective to provide a sufficient space-creepage distance for insulation between each neighboring layers of turns of both of the primary winding 16 and the secondary windings 17A and 17B. Also, while if both of the primary winding 16 and the secondary windings 17A and 17B are formed by the use of a winding wire having reinforced insulation, the magnetic coupling between the primary winding 16 and the secondary windings 17A and 17B will be lowered thereby failing to provide a desired transformer performance, the use of the winding wire having reinforced insulation only for the primary winding 16 such as accomplished in the illustrated embodiment of the present invention is effective to secure a high magnetic coupling between the primary winding 16 and the secondary windings 17A and 17B, thereby allowing the transformer of the present invention to exhibit the desired transformer performance.

When the ends of the primary winding 16 prepared from the winding wire having reinforced insulation are soldered to the respective terminal pins as indicated by H, generally horizontally extending portions S1 of the insulator protecting the primary winding 16 deteriorate in its insulating property under the influence of heat evolved during the soldering operation. The space-creepage distance D1 from that portions S2 of the respective lead-out ends **16*a* and 16*b* of the primary winding 16 to the adjacent ends of the secondary windings 17A and 17B (i.e., lower ends as viewed in FIG. 1) around the auxiliary bobbin region 12 extends in a direction axially of the auxiliary bobbin region 12** a length sufficient to satisfy the safety standard requirements.

Figure 10:
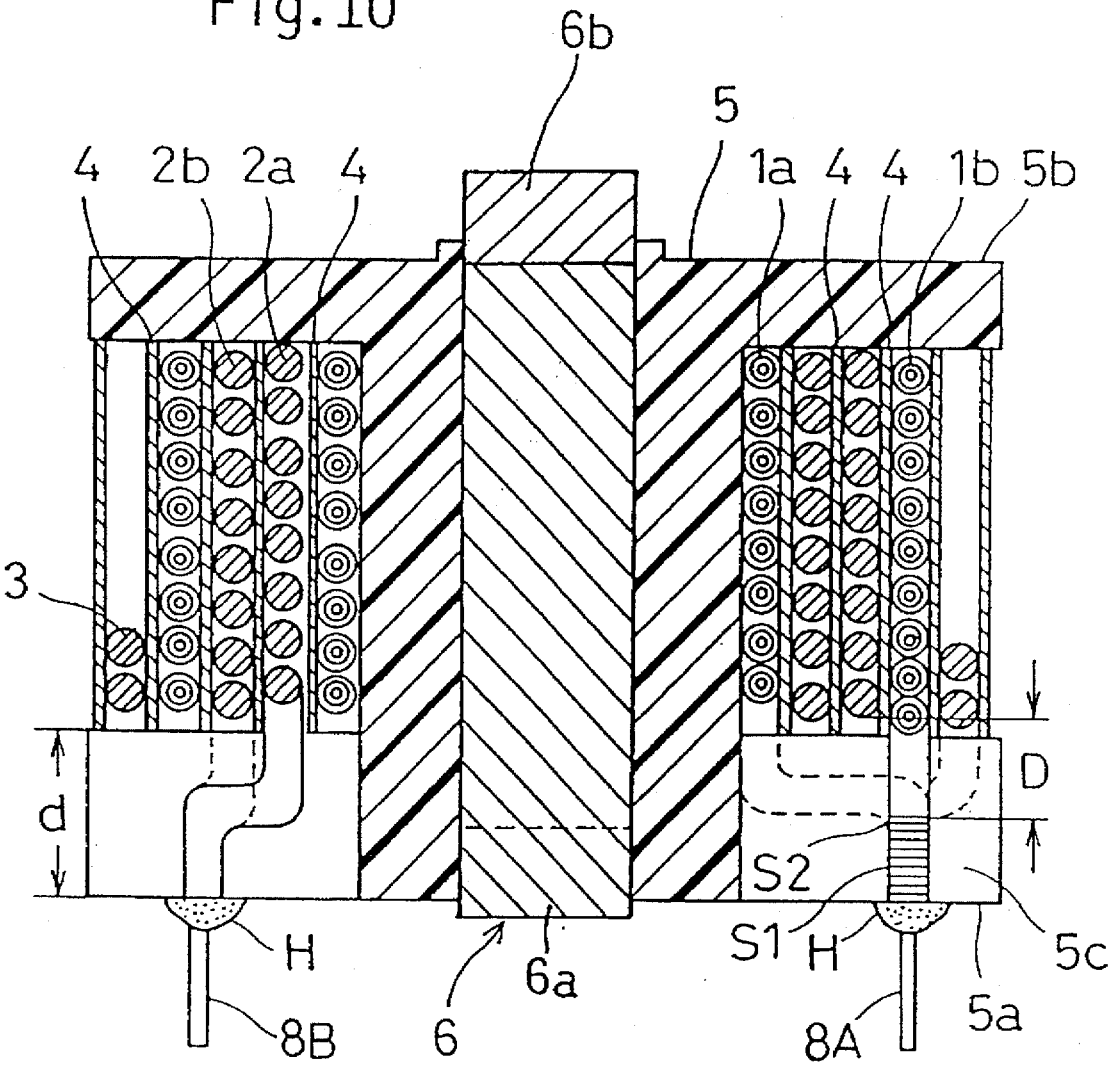
FIG. 10 is a longitudinal sectional view of the conventional transformer.

In other words, the illustrated transformer is so designed and so structured that of the primary and secondary windings 16, 17A and 17B wound around the bobbin 10, a part of the winding formed by the winding wire having reinforced insulation is wound around the auxiliary bobbin region 12 to allow the auxiliary bobbin region 12, that is used for that part of the primary winding 16 and the base winding 18 to be wound therearound, to provide the required space-creepage distance D1 which is stipulated in the safety standards. In contrast thereto, according to the prior art transformer shown in and discussed with reference to FIG. 10, the collar 5*a* of a relatively great thickness irrelevant to the coiling of the windings which ought to be used therefor is employed to secure the required space-creepage distance D. Accordingly, comparison between FIGS. 1 and 10 makes it clear that, for a given number of turns of the windings, the bobbin 10 used in the transformer according to the first preferred embodiment of the present invention has a size (the length and the width as measured in a direction parallel and transverse to the longitudinal sense of the transformer, respectively) smaller than that of the bobbin 5 shown in FIG. 10 and, therefore, the transformer of the present invention is suited for use as a transformer in a high frequency power source that is generally required to be compact in size.

Figure 5:
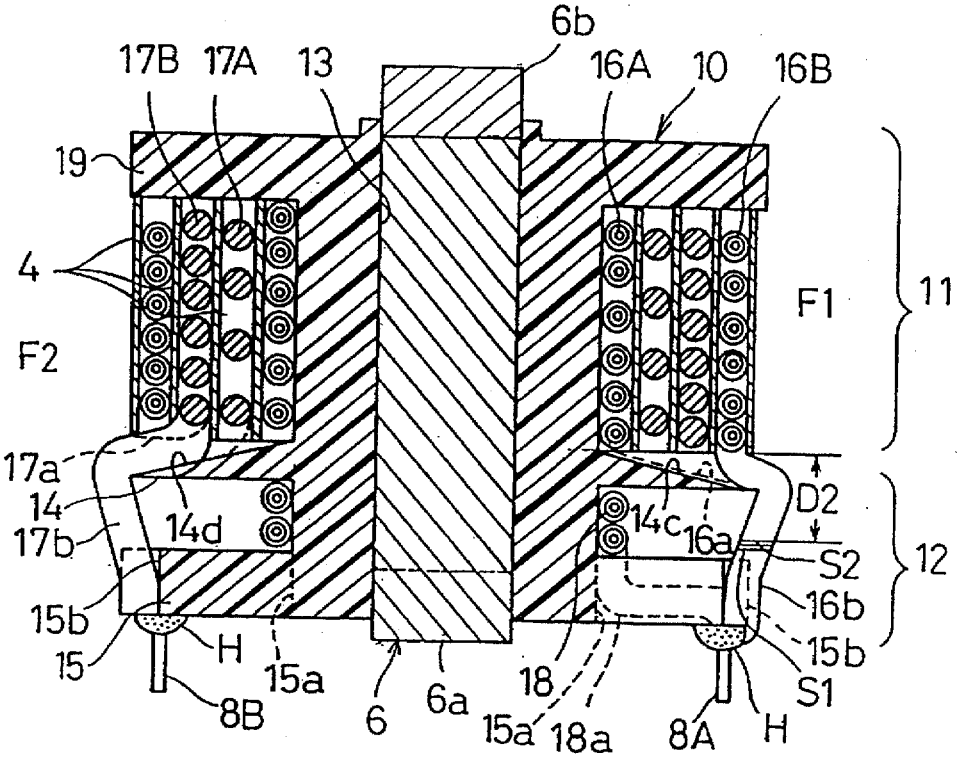
FIG. 5 is a longitudinal sectional view of the transformer according to a second preferred embodiment of the present invention.
Figure 6:
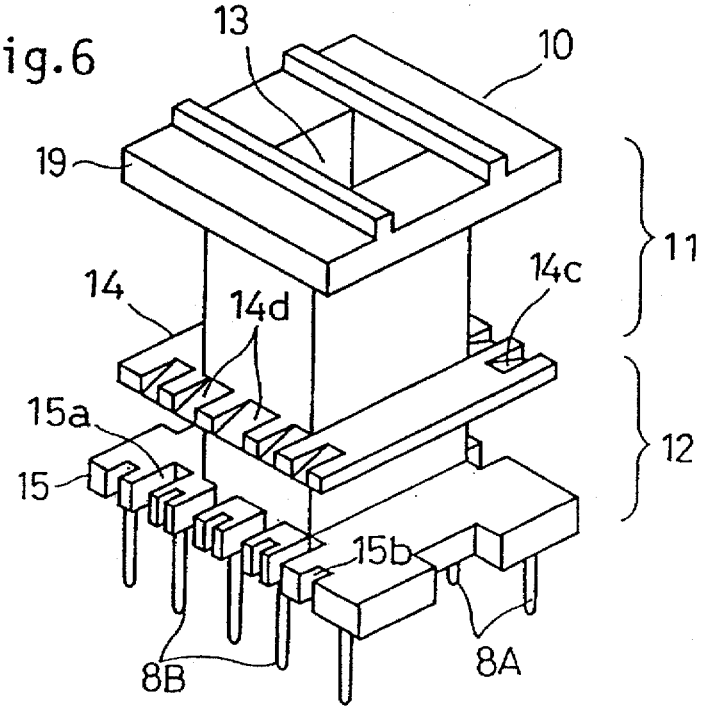
FIG. 6 is a perspective view of the bobbin used in the transformer shown in FIG. 5.

Referring now to FIG. 5, there is shown in a longitudinal sectional view the transformer according to a second preferred embodiment of the present invention. The bobbin 10 used in the transformer shown in FIG. 5 is shown in FIG. 6 in a perspective view. According to the second preferred embodiment of the present invention, the transformer shown in FIGS. 5 and 6 is substantially similar to that shown in FIGS. 1 to 4 except for the following differences. Specifically, in place of the insertion grooves 14*a* and 14*b* which are employed in the first preferred embodiment of the present invention as inwardly recessed from the outer edges of the corresponding collar pieces of the intermediate collar 14, first and second lead-out grooves 14*c* and 14*d* each inclined downwardly from the adjacent side face F1 or F2 towards the auxiliary bobbin region 12 are formed in the corresponding collar pieces of the intermediate collar 14 as best shown in FIG. 6 without extending completely across the thickness of the intermediate collar 14.

In addition, the entire number of turns of the primary winding 16 in the form of the winding wire having reinforced insulation and the entire number of turns of the secondary windings 17A and 17B are would around the main bobbin region 11 while only the base winding 18 is wound around the auxiliary bobbin region 12. The lead-out ends 16*a* and 16*b* of the primary winding 16 situated in the main bobbin region 11 are guided downwardly and slantwise along the lead-out grooves 14*c* and 14*d* towards the outer edges of the corresponding collar pieces of the intermediate collar 14 so as to extend across the auxiliary bobbin region 12 and are then engaged in the lead grooves 15*b* in the opposite collar pieces of the second collar 15 before they are wound around and soldered as at H to the terminal pins 8A. In a manner similar to the ends of the primary winding 16, the respective ends 17*a* and 17*b* of the auxiliary windings 17A and 17B are guided downwardly and soldered as at H to the terminal pins 8B. Also, the lead-out ends 18*a* of the base winding 18 situated in the auxiliary bobbin region 12 are engaged in the lead grooves 15*a* and are then soldered as at H to the terminal pins 8A.

The transformer according to the second embodiment of the present invention differs from that according to the first embodiment of the present invention in that the whole number of turns of the primary winding 16 prepared from the winding wire having reinforced insulation is wound around the main bobbin region 11. However, according to the second preferred embodiment of the present invention, the lead-out ends 16*a* and 16*b* of the primary winding 16 drawn outwardly from the main bobbin region 11 are soldered to the terminal pins 8A after having straddled the auxiliary bobbin region 12. Accordingly, the space-creepage distance D2 from respective portions S2 of the lead-out ends 16*a* and 16*b* of the primary winding 16 which are not thermally deteriorated to the lead-out ends of the secondary windings 17A and 17B situated within the main bobbin region 11 (i.e., lower ends as viewed in FIG. 5) extends in a direction axially of the auxiliary bobbin region-12 a length sufficient to satisfy the safety standard requirements as is the case with that in the first preferred embodiment of the present invention. Specifically in this second embodiment of the present invention, since the whole number of turns of the primary winding 16 and the whole number of turns of the secondary windings 17A and 17B are wound around the main bobbin region 11, the coiling process can be simplified advantageously.

Figure 7:
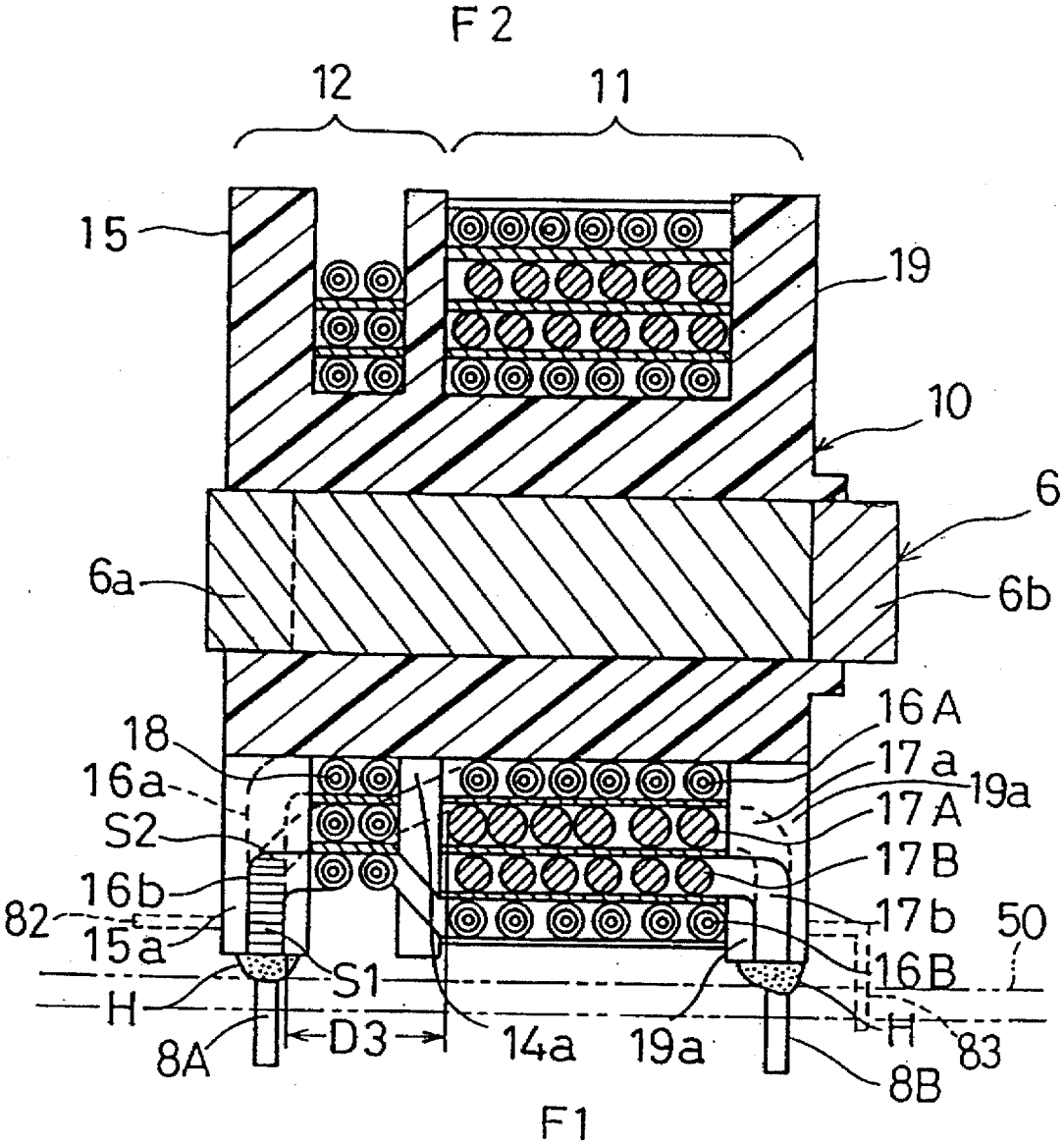
FIG. 7 is a longitudinal sectional view of the transformer according to a third preferred embodiment of the present invention.

The transformer according to a third preferred embodiment of the present invention is shown in FIG. 7 in a longitudinal sectional representation. It is, however, to be noted that the transformer shown in FIG. 7 is of a transverse type with its longitudinal axis oriented horizontally. This transformer shown in FIG. 7 is substantially similar to that shown in and described in connection with the first embodiment of the present invention except that, according to the third embodiment of the present invention, the first collar 19 is formed with lead grooves 19*a* which are similar to the lead grooves 15*a* in the second collar 15. Also, the terminal pins 8A of the first row adjacent the first side face F1. The outer edges of the collar piece of each of the first and second collars 19 and 15 adjacent the side face F1 is provided with the respective row of the terminal pins 8A or 8B that extend downwardly as viewed in FIG. 7. Thus, it will readily be seen that when the transformer shown in FIG. 7 is mounted on the printed circuit board 50 the core 6 inserted in the through-hole 13 extends substantially parallel to the printed circuit board 50 to render the transformer of FIG. 7 to be of the transverse type.

The primary winding 16 prepared from the winding wire having reinforced insulation is wound in a relatively great number of turns around the main bobbin region 11 of the bobbin 10 and is, after having passed through the insertion grooves 14*a*, wound around the auxiliary bobbin region 12. Thus, the primary winding 16 is wound in part around the main bobbin region 11 and in part around the auxiliary bobbin region 12 with the lead-out ends 16*a* and 16*b* guided through the lead grooves 15*a* to and then soldered as at H to the associated terminal pins 8A. The secondary windings 17A and 17B each prepared from the normal insulated winding wire are completely wound around the main bobbin region 11 of the bobbin 10 with the associated lead-out ends 17*a* and 17*b* guided through the corresponding lead grooves 19*a* to and then soldered as at H to the respective terminal pins 8B. The base winding 18 has its whole number of turns formed around the auxiliary bobbin region 12 and also has its lead-out ends 18*b* guided through the lead groove 15*a* to and then soldered as at H to the associated terminal pins 8A.

The transformer according to the third embodiment of the present invention differs from that according to the first embodiment of the present invention in respect of the manner in which and where the respective rows of the terminal pins 8A and 8B associated respectively with the primary winding 16 and the secondary windings 17A and 17B are positioned. However, the space-creepage distance D3 between the primary winding 16 and the secondary windings 17A and 17B where there should be a required space-creepage distance is of a length sufficient to satisfy the safety standard requirements as is the case with that in the transformer according to the first embodiment of the present invention.

Figure 8:
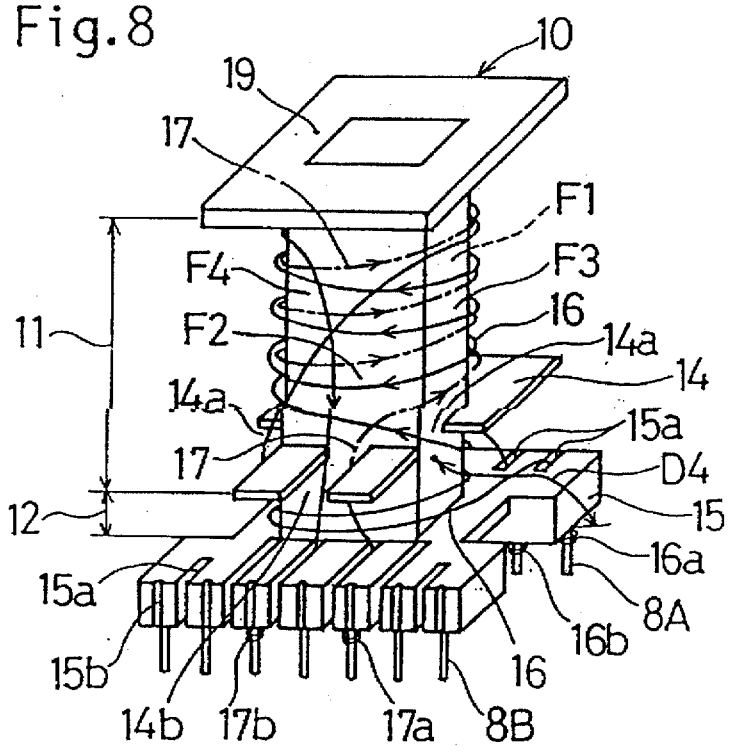
FIG. 8 is a perspective view of the bobbin which may be employed in the transformer according to a fourth preferred embodiment of the present invention.

Referring to FIG. 8, there is shown the upright transformer according to a fourth preferred embodiment of the present invention. The intermediate collar 14 of the bobbin 10 used in the transformer shown in FIG. 8 is formed with first insertion grooves 14*a* defined at three locations in the collar pieces thereof adjacent the third and fourth side faces F3 and F4 of the bobbin 10 and is also formed at a single location with a second insertion groove 14*b* defined in the collar piece thereof adjacent the second side face F2 of the bobbin 10. As shown by the solid line, the primary winding 16, prepared from the winding wire having reinforced insulation, having one lead-out end 16*a* soldered to the terminal pin 8A on the side of the first side face F1 extend therefrom through the lead groove 15*a* in the second collar 15 so as to be wound around the auxiliary bobbin region 12 and then extend through the first insertion groove 14*a* on the side of the third side face F3 so as to be wound around the main bobbin region 11. The primary winding 16 after having been wound around the main bobbin region 11 further extends through the insertion groove 14*a* on the side of the fourth side face F4, subsequently traverse the auxiliary bobbin region 12 and finally extends through the different lead groove 15*a* with the opposite lead-out end 16*b* soldered to the different terminal pin 8A.

On the other hand, the secondary winding 17 in the form of the normal insulated winding wire has, as shown by the single-dotted broken lines, their lead-out ends 17*a* soldered to the terminal pins 8B on the side of the second side face F2 of the bobbin 10 and then extend therefrom through the lead groove 15*a* in the second collar 15 so as to traverse the auxiliary bobbin region 12. The secondary winding 17 having traversed the auxiliary bobbin region 12 further extends through the second insertion groove 14*b* on the side of the second side face F2 so as to be wound around the main bobbin region 11. After having been wound around the main bobbin region 11, the secondary winding 17 extends again through the second insertion groove 14*b* and subsequently traverses the auxiliary bobbin region 12 with the opposite lead-out ends 17*b* finally soldered to the different terminal pins 8B.

Although not shown, the base winding is wound around the auxiliary bobbin region 12 with its opposite ends extending through the respective lead grooves 15*a* in the second collar 15 and then soldered to the terminal pins 8A.

According to the fourth embodiment of the present invention, since the first insertion grooves 14*a* are formed in the respective collar pieces of the intermediate collar 14 adjacent the third and fourth side faces F3 and F4 of the bobbin 10, the primary winding 16 wound around the main bobbin region 11 extends from the third or fourth side face F3 or F4 to the first or second side face F1 or F2 through the first insertion groove 14*a* and is then soldered to the terminal pin 8A situated on the side of the first side face F1. Accordingly, the space-creepage distance D4 accomplished in the transformer shown in FIG. 8 is defined in terms of the distance from respective portions of the lead-out ends 16*a* and 16*b* connected to the terminal pins 8A, which portions are not thermally deteriorated, to the first insertion groove 14*a* at which the secondary winding 17 is exposed. Assuming that the axial length of the auxiliary bobbin region 12 remains the same, this space-creepage distance D4 is considerably greater than any one of the space-creepage distances D1, D2 and D3 in a quantity corresponding to the distance over which the primary winding 16 extends so as to detour from the first side face F1 to the third or fourth side face F3 or F4 and, therefore, the safety standard requirements can be sufficiently satisfied.

Also, since the primary winding 16 is passed through the first insertion groove 14*a* in the intermediate collar 14 and the secondary winding 17 is passed through the second insertion groove, there is no possibility of the wires being mingled which would occur when the primary and secondary windings 16 and 17 are passed through a single and common groove and, therefore, a line drawing and a soldering can be exercised easily.

However, it is to be noted that, with no second insertion groove 14*b* utilized, the primary and secondary windings 16 and 17 may be passed through the first insertion grooves 14*a*. It is also to be noted that the number of the first insertion groove 14*a* may be one and may be defined in the corresponding collar piece of the intermediate collar 14 adjacent the third or fourth side face F3 or F4.

Figure 9:
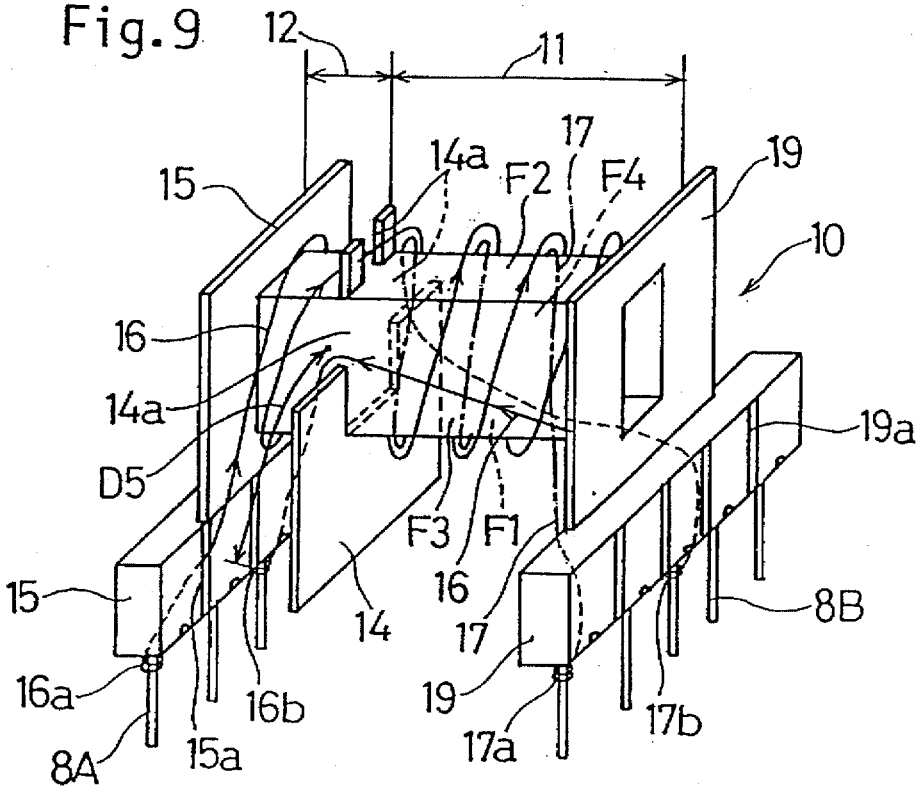
FIG. 9 is a perspective view of the bobbin which may be employed in the transformer according to a fifth preferred embodiment of the present invention.

FIG. 9 illustrates the transformer of a transverse type according to a fifth preferred embodiment of the present invention. The first and second collars 19 and 15 of the bobbin 10 shown therein are provided with the rows of the terminal pins 8B and 8A, respectively, on one side of the bobbin 10 adjacent the first side face F1. The intermediate collar 14 is formed with three insertion grooves 14*a*, which are positioned on the respective sides adjacent the second side face F2 opposite to the first side face F1, the third and fourth sides F3 and F4.

The primary winding 16, in the form of the winding wire having reinforced insulation, having one lead-out end 16*a* soldered to the terminal pin 8A provided in the second collar 15 extend, as shown by the solid line in FIG. 9, therefrom through the lead groove 15*a* in the second collar 15 into the auxiliary bobbin region 12 where it is partly wound. The primary winding 16 having been partly wound around the auxiliary bobbin region 12 subsequently extends through the insertion groove 14*a* in the intermediate collar 14, that is situated on the side adjacent the second side face F2, into the main bobbin region 11 where it is further wound. After having been wound around the main bobbin region 11, the primary winding 16 further extends through the insertion groove 14*a* on the side adjacent the third side face F3, traversing the auxiliary bobbin region 12 through the lead groove 15*a* with the opposite lead-out end 16*b* finally soldered to the terminal pin 8A. Although not shown, the primary winding 16 which has been wound around the main bobbin region 11 has an intermediate tap wire drawn from a joint between the winding portions 16A and 16B, which tap wire extends through the insertion groove 14*a* on the side adjacent the forth side face F4 and is, after having traversed the auxiliary bobbin region 12, soldered to the different terminal pin 8A which forms the intermediate tap terminal (See FIG. 3).

On the other hand, the secondary winding 17 in the form of the normal insulated winding wire having the lead-out end 17*a* soldered to the terminal pin 8B provided in the first collar 19 extends therefrom, as shown by the single-dotted broken lines, through the lead groove 19*a* in the first collar 19 into the main bobbin region 11 where it is wound therearound. The opposite lead-out end 17*b* of the secondary winding 17 is, after having passed through the different lead-out groove 19*a* in the first collar 19, soldered to the different terminal pin 8B.

According to the fifth embodiment of the present invention, since the insertion grooves 14*a* are situated on respective sides adjacent the second side face F2 opposite to the first side face F1 adjacent the rows of the terminal pins 8A and 8B, the third side face F3 and the fourth side face F4, respectively, the primary winding 16 in the form of the winding wire having reinforced insulation is, after having extended through the insertion groove 14*a* along a passage including the third or fourth side face, brought to the first side face F1 and is then soldered to the terminal pin 8A. Accordingly, the space-creepage distance DS exhibited in the transformer shown in FIG. 9 is defined in terms of the distance from respective portions of the lead-out ends 16*a* and 16*b* connected to the terminal pins 8A, which portions are not thermally deteriorated, to one of the three insertion grooves 14*a* at which the secondary winding 17 is exposed, said one of the three insertion grooves 14*a* being closest to such terminal pin 8A, for example, the insertion groove 24 situated adjacent the third side face F3. Assuming that the axial length of the auxiliary bobbin region 12 remains the same, this space-creepage distance D4 is considerably greater than any one of the space-creepage distances D1, D2 and D3 in a quantity corresponding to the distance over which the primary winding 16 extends so as to detour from the first side face F1 to the third or fourth side face F3 or F4 and, therefore, the safety standard requirements can be sufficiently satisfied.

Also, since the three insertion grooves 14*a* are employed in the intermediate collar 14, there is no possibility of the wires being mingled which would occur when different portions of the primary winding 16 are passed through a single and common groove and, therefore, a line drawing and a soldering can be exercised easily.

However, it is to be noted that, in the practice of the fifth preferred embodiment of the present invention, the single insertion groove 14*a* may be employed in place of the three insertion grooves 14*a* and, in such case, the single insertion groove 14 is preferably formed in the intermediate collar 14 at a location furthest from the first side face F1, that is, adjacent the second side face F2 so that the sufficiently long space-creepage distance can be secured.

It is to be noted that in any one of the first to fifth preferred embodiments of the present invention the primary winding has been described as prepared from the winding wire having reinforced insulation, the use of the winding wire having reinforced insulation for the secondary windings and the use of the normal insulated winding wire for both of the primary winding and the base winding may serve the purpose. In such case, the location where each of the windings is wound should be varied. By way of example, the secondary winding prepared from the winding wire having reinforced insulation is wound in a relatively great number of turns around the main bobbin region and the remaining number of turns around the auxiliary bobbin region and both of the primary winding and the base winding each prepared from the normal insulated winding wire are entirely wound around the main bobbin region. Also, the base winding prepared from the normal insulated winding wire may be wound around the auxiliary bobbin region separately or in an overlapping relation with the primary winding or a part of the secondary winding.

All that is necessary in the practice of the present invention is that a relatively great number of turns of each of the primary and secondary windings is wound around the main bobbin region, and that of the primary and secondary windings the winding prepared from the winding wire having reinforced insulation has the lead-out ends for connection with an external circuit which are in turn connected to the respective terminal pins after having passed across the auxiliary bobbin region. By this design, the space-creepage distance which satisfies the safety standard requirements is secured.

Alternatively, all of the primary, secondary and base windings may be prepared from the winding wire having reinforced insulation.

The upright transformer shown in any one of FIGS. 1, 4 and 8 is available in two types, i.e., as shown by the phantom line in FIG. 1, the type in which terminal pins 80 are secured to the second collar 15 so as to extend radially outwardly from the outer edge thereof and the type in which terminal pins 81 extending radially outwardly from the outer edge of the second collar 15 are bent so as to extend downwardly in a direction parallel to the longitudinal axis of the bobbin 10 thereby to form respective mounting legs also as shown by the phantom line in FIG. 1.

Similarly, the transverse transformer shown in any one of FIGS. 7 and 9 is also available in two types, i.e., as shown by the phantom line in FIG. 7, the type in which terminal pins 82 are secured to the second and first collars 15 and 19 so as to extend outwardly from respective end faces of the second and first collars 15 and 19 in a direction parallel to the longitudinal axis of the bobbin 10 and the type in which terminal pins 83 extending outwardly from respective end faces of the second and first collars 15 and 19 are bent so as to extend downwardly in a direction transverse to the longitudinal axis of the bobbin 10 thereby to form respective mounting legs as shown by the phantom line in FIG. 9. The present invention is equally applicable to any one of these types of the transformers.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

What is claimed is:

1. A transformer which comprises:

a bobbin having an axial length extending along a longitudinal axis and a through-hole defined therein along the longitudinal axis;

a core member inserted in said through-hole;

an intermediate collar mounted on the bobbin at a location generally intermediate of the length of the bobbin dividing the axial length of the bobbin into main and auxiliary bobbin regions located along the bobbin on opposite sides of the intermediate collar;

primary and secondary windings wound around the main bobbin region in an overlapping fashion with each other, at least one of said primary and secondary windings being prepared from a winding wire having reinforced insulation of a multi-layered structure;

terminal pins to which opposite ends of said winding having reinforced insulation are soldered, said ends traversing the auxiliary bobbin region to reach the terminal pins, portions of said ends adjacent the terminal pins being subjected to heat when said ends are soldered to said terminal pins such that said portions may have deteriorated insulation properties; and a third winding wound around the auxiliary bobbin region, the third winding being prepared from a winding wire having reinforced insulation of a multi-layered structure, whereby said portions are separated from the windings in the main bobbin region by a space creepage distance sufficient to meet safety standard requirements while at the same time resulting in a transformer that is compact in size for a given number of turns of the windings.

2. The transformer as claimed in claim 1, wherein said intermediate collar is formed with insertion grooves inwardly recessed from an outer edge of the intermediate collar for passage of the primary winding so as to extend from the main bobbin region to the auxiliary bobbin region.

3. The transformer as claimed in claim 2, further comprising first and second rows of terminal pins associated with the first and second windings, respectively, and wherein said bobbin has first to fourth side faces, the first and second side faces being opposite to each other while the third and fourth side faces are opposite to each other, said auxiliary bobbin region having a collar radially outwardly protruding therefrom and spaced a distance from the intermediate collar to define the auxiliary bobbin region between said collar and said intermediate collar, wherein said insertion grooves are defined in one portion of the collar of the auxiliary bobbin region adjacent at least one of the third and fourth side faces of the bobbin, and said first and second rows of the terminal pins are provided adjacent the first and second side faces, respectively.

4. The transformer as claimed in claim 3, wherein the other of the primary and secondary windings is prepared from a normal insulated winding wire having a single insulating layer, said at least one of the primary and secondary windings being passed through said insertion groove, and wherein a portion of said intermediate collar adjacent the terminal pins for the other of the primary and secondary windings is formed with second insertion grooves.

5. The transformer as claimed in claim 1 further comprising a first collar protruding radially outward from the main bobbin region, said first collar being spaced a distance from the intermediate collar to define the main bobbin region between the first collar and the intermediate collar.

6. The transformer as claimed in claim 5, further comprising a second collar protruding radially outward from the auxiliary bobbin region, the second collar being spaced a distance from the intermediate collar to define the auxiliary bobbin region between the second collar and the intermediate collar.

* * * * *